US007390209B2

(12) United States Patent
Liu

(10) Patent No.: US 7,390,209 B2
(45) Date of Patent: Jun. 24, 2008

(54) WATER-PROOF ELECTRIC CONNECTOR MODULE

(75) Inventor: Li-Chen Liu, Taipei Hsien (TW)

(73) Assignee: Wealleys Technologies Co., Ltd., XinJian, Taipei County (TW)

( * ) Notice: Subject to any disclaimer, the term of this patent is extended or adjusted under 35 U.S.C. 154(b) by 0 days.

(21) Appl. No.: 11/358,553

(22) Filed: Feb. 22, 2006

(65) Prior Publication Data

US 2007/0197076 A1 Aug. 23, 2007

(51) Int. Cl.
*H01R 13/52* (2006.01)

(52) U.S. Cl. ..... 439/271; 439/320

(58) Field of Classification Search ..... 439/135, 439/271, 320, 502, 680
See application file for complete search history.

(56) References Cited

U.S. PATENT DOCUMENTS 4,684,161 A * 8/1987 Egner et al. ..... 294/1.1
4,997,391 A * 3/1991 Federico et al. ..... 439/580
5,066,905 A * 11/1991 Betton et al. ..... 324/133
5,707,250 A * 1/1998 Smithson ..... 439/504
6,104,855 A * 8/2000 Jeon ..... 385/139
6,287,136 B1 * 9/2001 Deutsch ..... 439/337
6,907,615 B1 * 6/2005 Alexander et al. ..... 725/80
7,101,223 B2 * 9/2006 Neumann et al. ..... 439/585
2002/0028607 A1 * 3/2002 Babel et al. ..... 439/680

* cited by examiner

*Primary Examiner*—Tho D Ta
*Assistant Examiner*—Travis Chambers

(57) ABSTRACT

A water-proof electric connector module comprises a cable with two ends each provided with a connector head. Each of the connector heads of the cable further includes a front flange encircling a plurality of receiving holes. The outer wall of the connector head is provided with an outer thread, which can be coupled with the inner thread of a complementary connector head at another cable; the complementary connector with an annular groove encircling a plurality of terminal pins. There is further a rotary lock shell encircling the complementary connector head, whereby a pair of connector heads will be stably connected. The connector head with an outer thread can be sealed by a guide head cap, which has a rotary lock shell and an inner thread, capable of being engaged with the outer thread, similar to the complementary connector head.

1 Claim, 7 Drawing Sheets

WATER-PROOF ELECTRIC CONNECTOR MODULE

FIELD OF THE INVENTION

The present invention relates to water-proof electric connectors, more particularly to a water-proof electric connector module wherein the connection between a pair of heads is secured by relative rotation; therefore, they are not easily detachable. The progression of the water-proof electric connector module in a hole will not be stopped by an obstacle; the front end of the water-proof electric connector module will not polluted by dusts, which may cause malfunction of the connector. The structure of the water-proof electric connector module is so simple that its usage is easy.

BACKGROUND OF THE INVENTION

An electric connector module capable of being assembled quickly of the prior art utilizes a pair of male and female connector heads to connect two cables. Since there is not a latch mechanism upon the coupling between the connector heads, the cable connection is easily detachable. Further, the water-proof mechanism at the cable connection is applied externally, such as water-proof tapes and silicon glue. These external measures are not reliable. Further, when the electric connector module is required to penetrate a wall through a hole, guide string connected to the front connector head is needed. However, the connector is easy to get blocked by an obstacle in the hole or get stuffed by dust and dirt in the hole, leading to malfunction of the connector.

To summarize, there are at least two disadvantages of the electric connector modules of the prior art.

1. The latch mechanism for a pair of connector heads to couple is too simple to avoid accidental separation.

2. The pulling of the connector along a hole in a wall will usually blocked by an obstacle and will result in dust accumulation in the front connector head, causing malfunction of the connector.

SUMMARY OF THE INVENTION

The primary objective of the present invention is to provide a water-proof electric connector module capable of being assembled quickly, wherein two lateral guide strings and a round guide end cap will bypass an obstacle in a wall smoothly. Further, the O-ring within the present invention will provide a water-proof function. To achieve the above objectives, the present invention as a water-proof electric connector module comprises a cable with two ends each provided with a connector head. Each of the connector heads of the cable further includes a front flange encircling a plurality of receiving holes. The outer wall of the connector head is provided with an outer thread, which can be coupled with the inner thread of a complementary connector head at another cable; the complementary connector with an annular groove encircling a plurality of terminal pins. There is further a rotary lock shell encircling the complementary connector head, whereby a pair of connector heads will be stably connected. The connector head with an outer thread can be sealed by a guide head cap, which has a rotary lock shell and an inner thread, capable of being engaged with the outer thread, similar to die complementary connector head. The front end of the guide head cap is provided with a transverse through hole for passing a guide string. The rotary lock shell includes an O-ring for attaining a water-proof effect at either of the connections.

The various objects and advantages of the present invention will be more readily understood from the following detailed description when read in conjunction with the appended drawings.

DETAILED DESCRIPTION OF THE PREFERRED EMBODIMENTS

Figure 1:
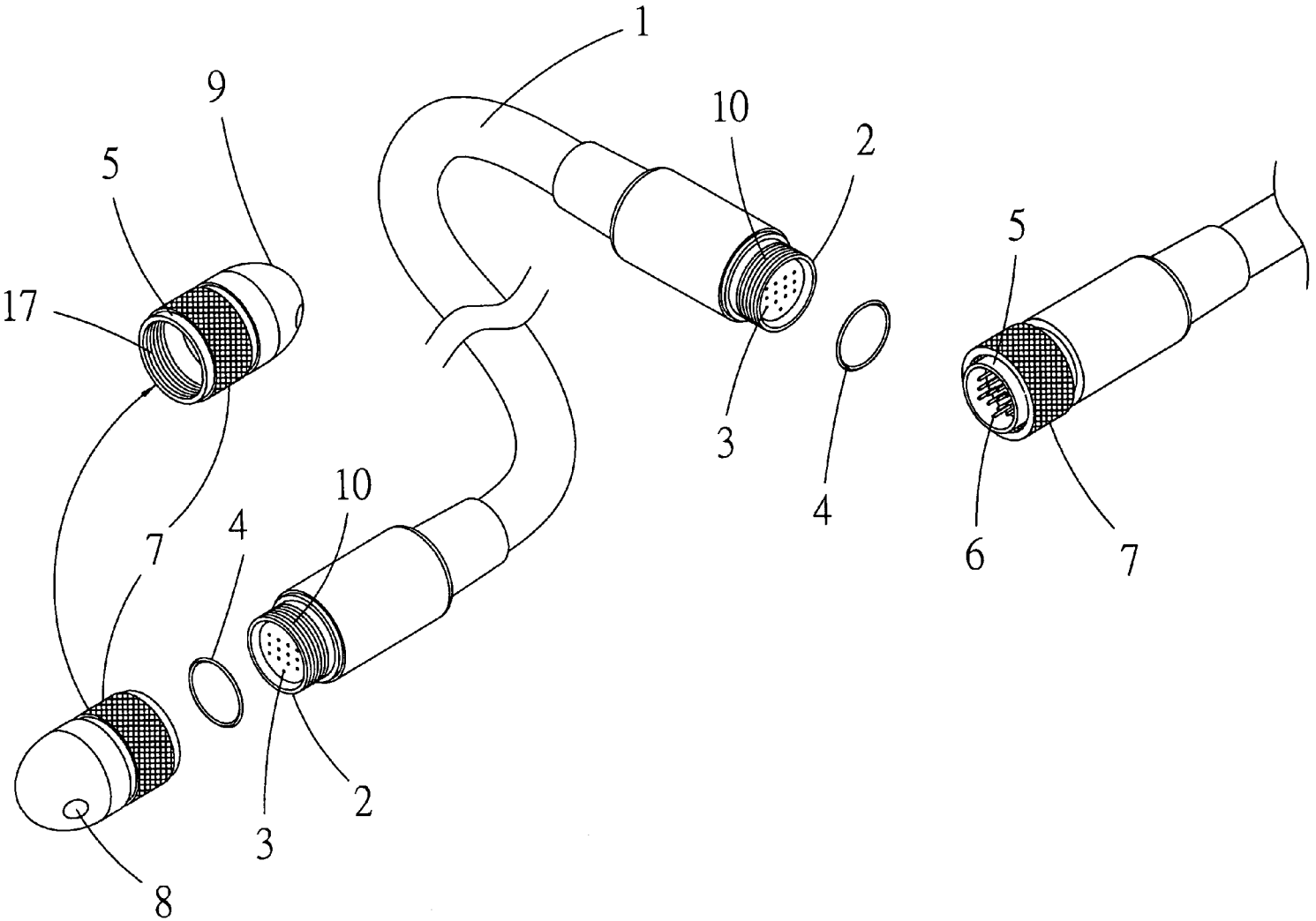
FIG. 1 is an exploded perspective view of a water-proof electric connector module of the present invention.
Figure 2:
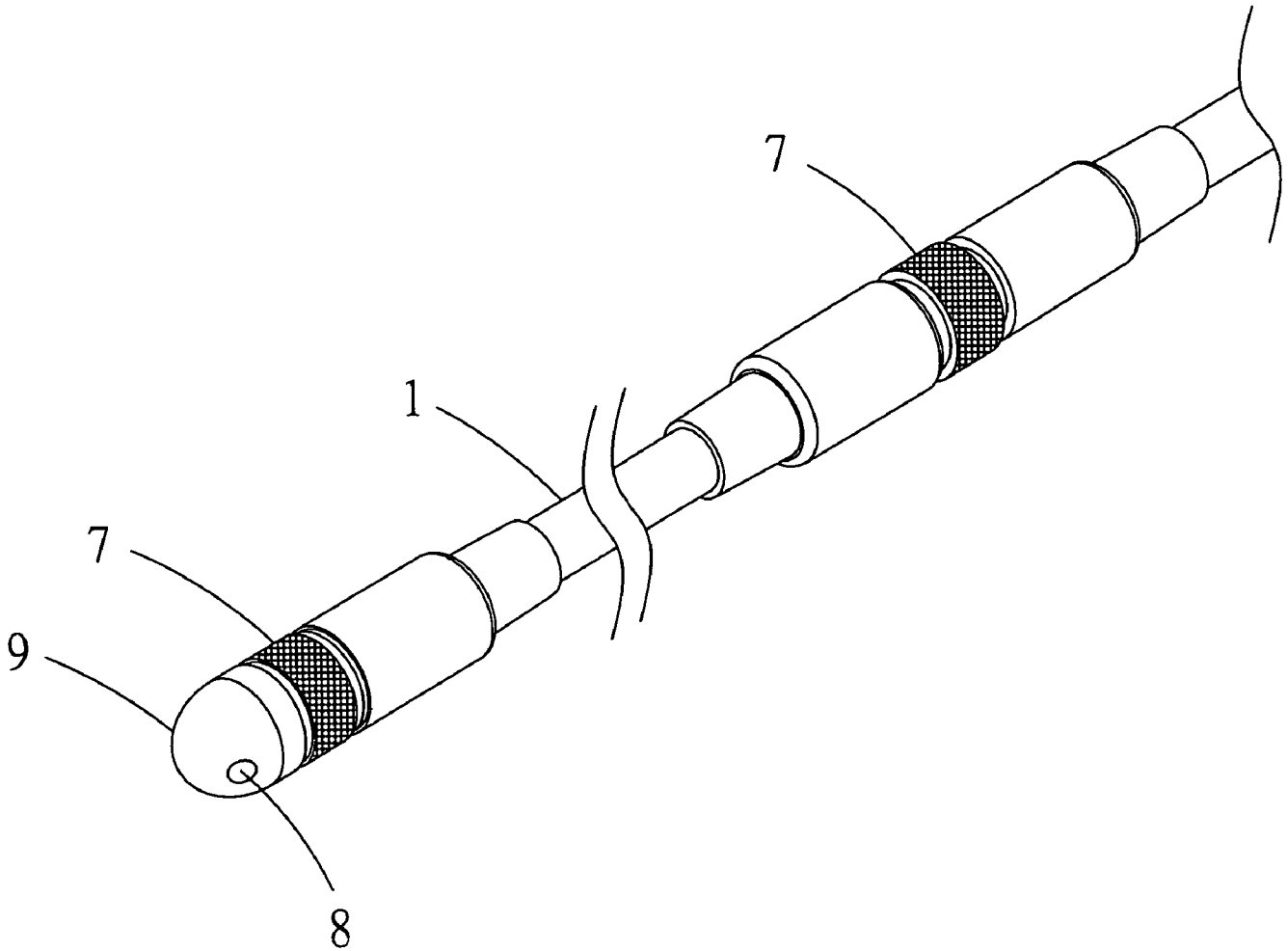
FIG. 2 is a perspective view of the water-proof electric connector module in FIG. 1.

Referring to FIGS. 1 and 2, a water-proof electric connector module according to the present invention comprises a cable 1 with two ends each provided with a connector head. Each of the connector heads of the cable 1 further includes a front flange 2 encircling a plurality of receiving holes 3. The outer wall of the connector head is provided with an outer thread 10, which can be coupled with the inner thread 17 of a complementary connector head at another cable; the complementary connector with an annular groove 5 encircling a plurality of terminal pins 6. There is further a rotary lock shell 7 encircling the complementary connector head, whereby a pair of connector heads will be stably connected. Each of the connector heads with the outer threads 10 can be sealed by a guide head cap 9, which has a rotary lock shell 7 and an inner thread 17, capable of being engaged with one of the outer threads 10, similar to the complementary connector head. The front end of the guide head cap 7 is provided with a transverse through hole 8 for passing a guide string.

Figure 3:
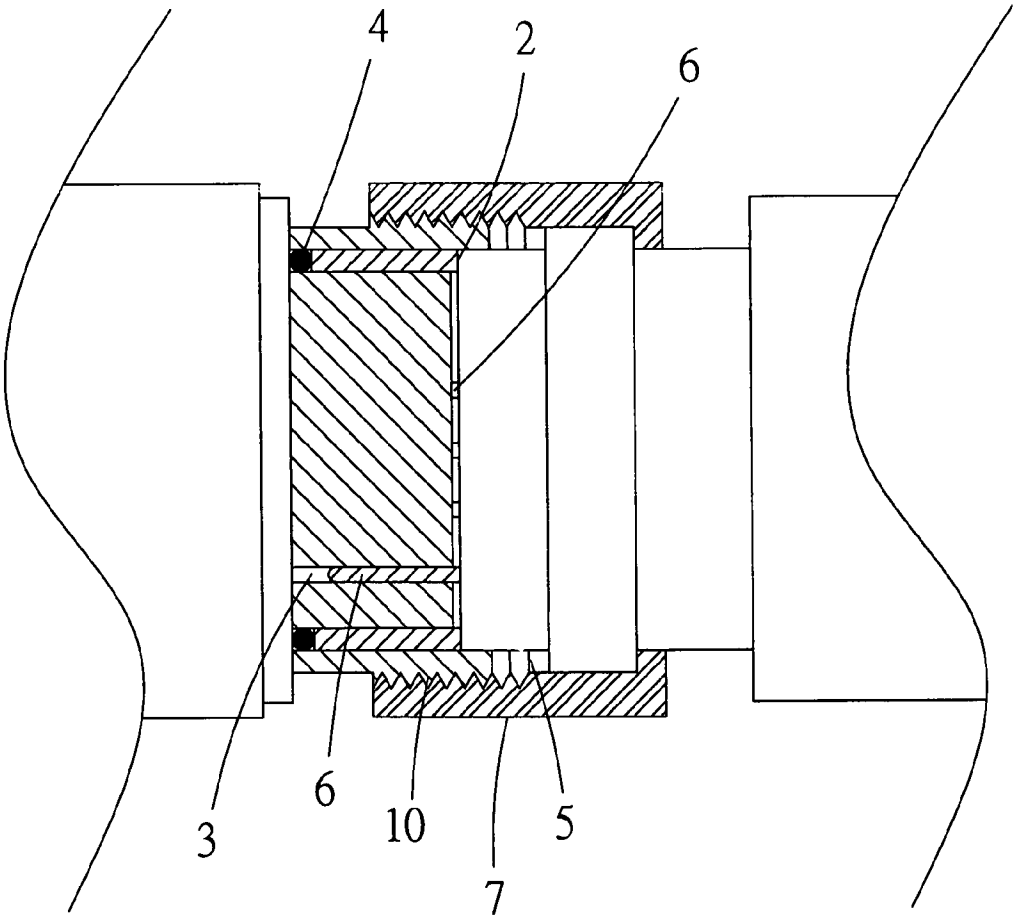
FIG. 3 is a side cross-sectional view of connecting portion of the water-proof electric connector module in FIG. 1.

Referring to FIG. 3, to connector the cable with connector head and another cable with at least one complementary connector head, the front flange 2 of either one of the connector heads is engaged with the annular groove of the complementary connector head after an O-ring 4 is firstly inserted between the pair of connector heads. The rotary lock shell 7 is then actuated to engage the inner thread 17 of the complementary connector head and the outer thread 10 of the connector head.

Figure 4:
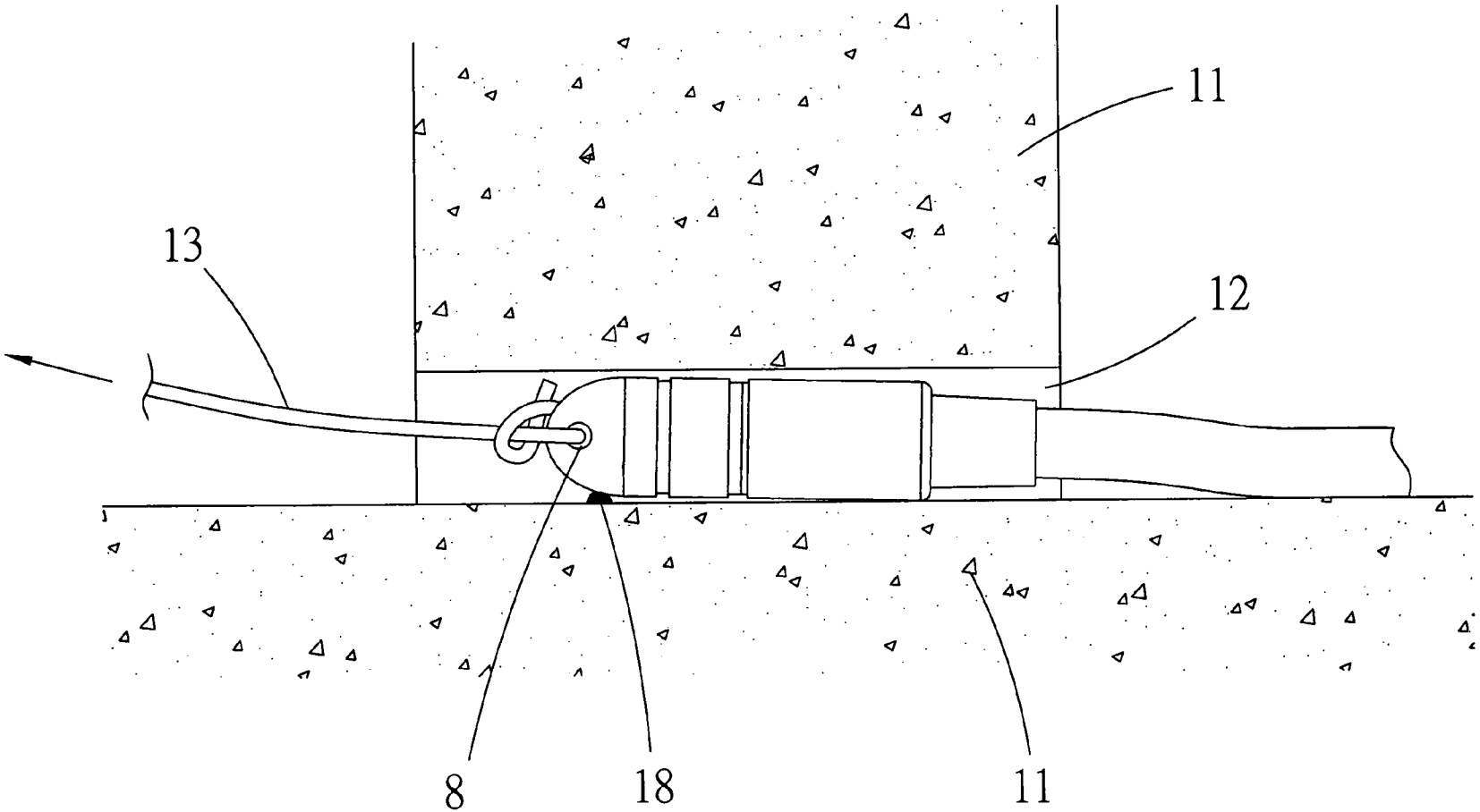
FIG. 4 illustrates the present invention passing through a hole in a wall.

Referring to FIG. 4, a guide string 13 is pierced through a transversely extending through hole 8 in the front portion of the guide end cap 9, whereby the electric connector module can be pulled along a hole 12 in a wall 11. The front portion has a round contour for avoiding blocking of the connector by an obstacle in the hole 12.

Figure 5:
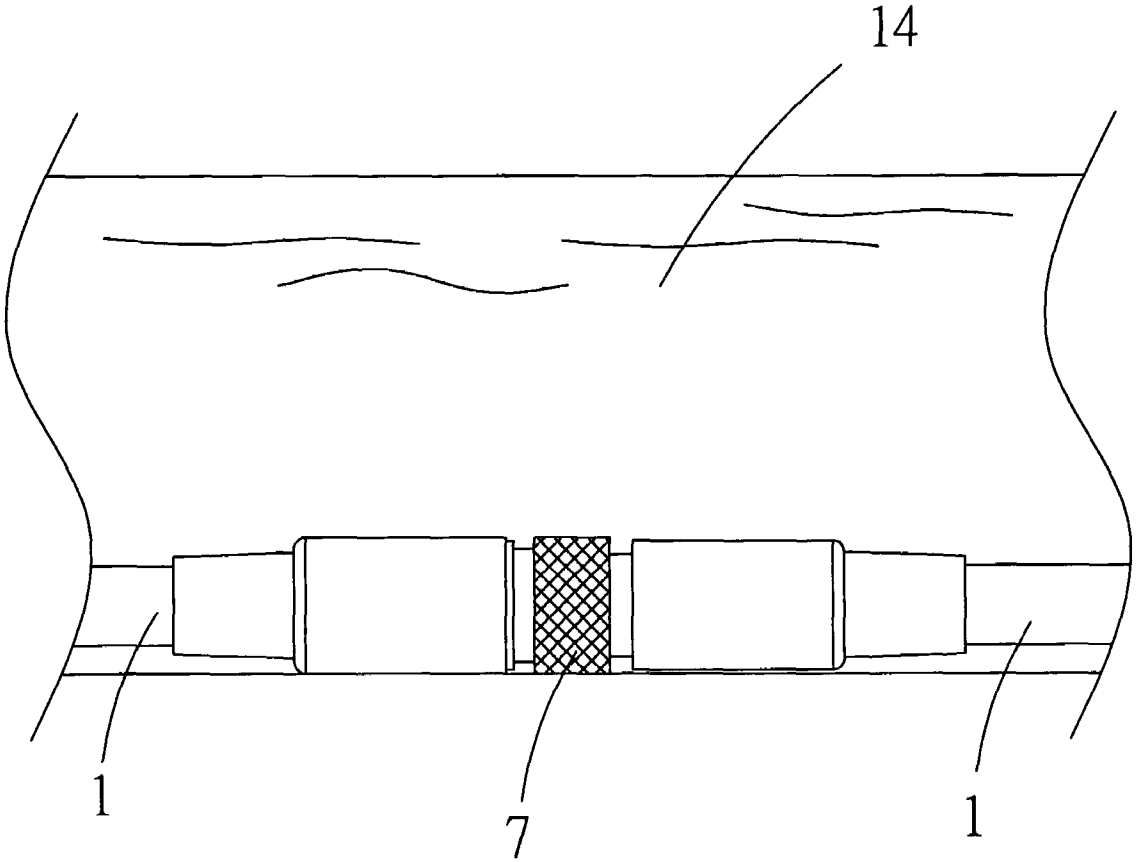
FIG. 5 illustrates the present invention being immersed in water.
Figure 6:
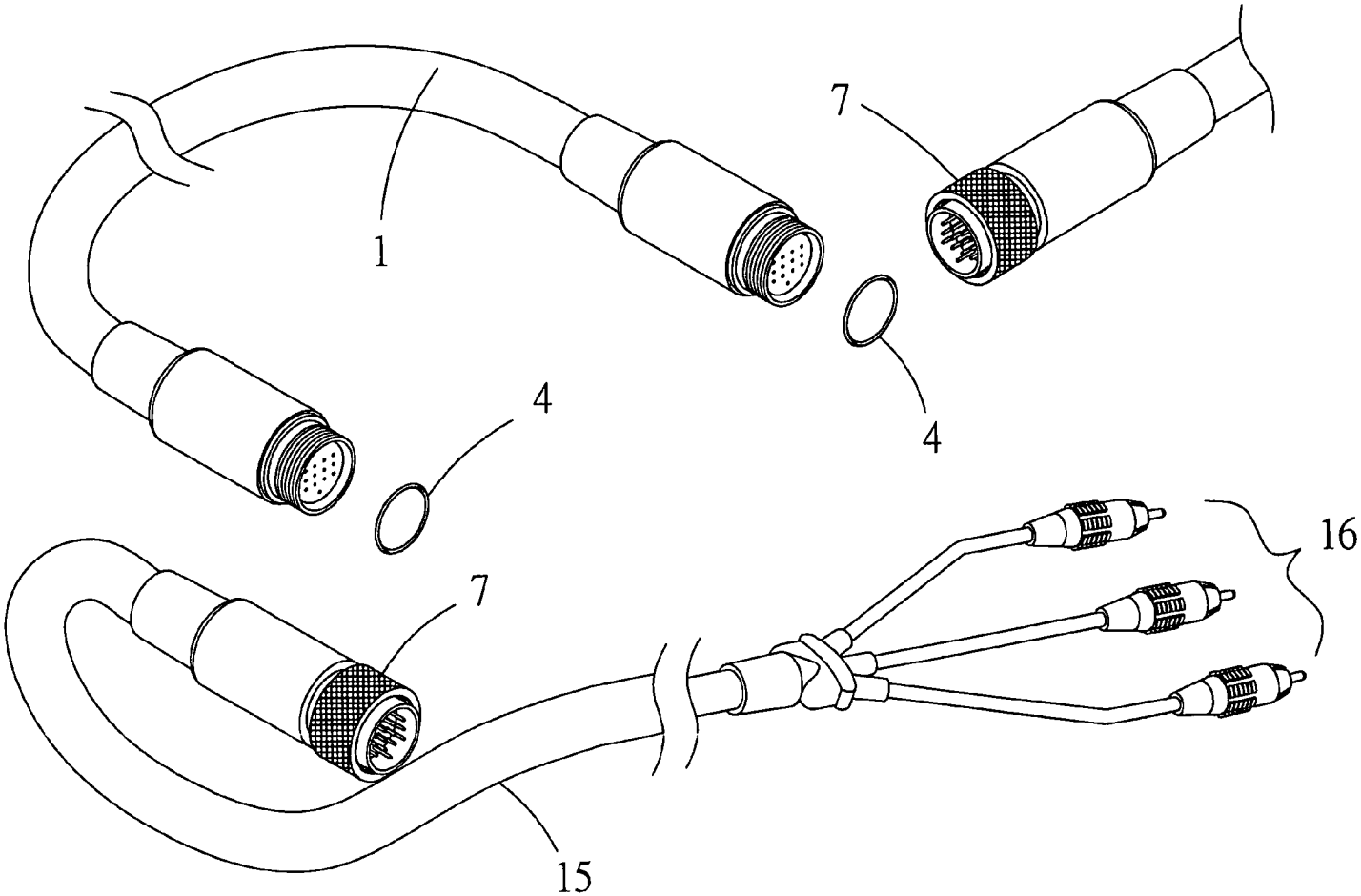
FIG. 6 illustrates the present invention before being connected to another signal wire.
Figure 7:
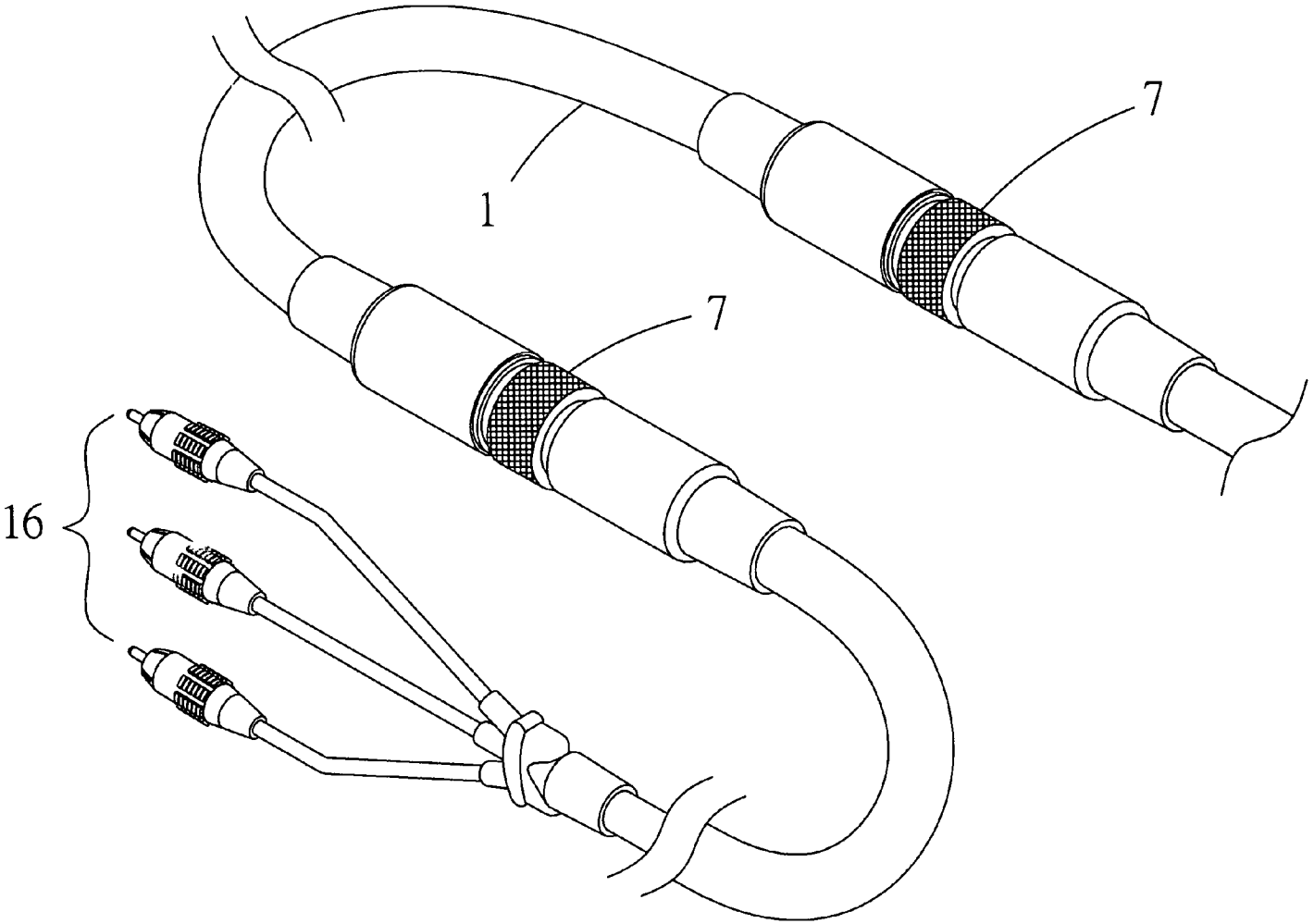
FIG. 7 illustrates the present invention after being connected to another signal wire.

Referring to FIG. 5, the present invention can be placed in water 14 and functions properly, because of the sealing effect provided by the O-ring 4. As shown in FIGS. 6 and 7, one end of the electric connector module is connected with a cable of different specification; in this case, it is an audio-video signal cable 15. The connection end of the audio-video signal cable 15 is also inserted with an O-ring 4 to be water-proof. The audio-video signal cable 15 is just one of the preferred embodiments.

Compared with the water-proof electric connector modules of the prior art, the present invention has the advantages as follows.

1. The connection between a pair of heads is secured by relative rotation, and therefore they are not easily detachable.

2. The progression of the water-proof electric connector module in a hole will not be stopped by an obstacle; the front end of the water-proof electric connector module will not polluted by dusts, which may cause malfunction of the connector.

3. The structure of the water-proof electric connector module is so simple that its usage is easy.

The present invention is thus described, and it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A water-proof electric connector module, comprising:

a cable;

a pair of connector heads provided at two ends of said cable each further including a annular front flange and a plurality of receiving holes encircled by said front flange, an outer wall of each of said connector heads being provided with an outer thread for the engagement with an complementary connector head having an inner thread on a corresponding inner wall, said complementary connector head being further provided with an annular groove, a plurality of terminal pins encircled by said annular groove and a rotary lock shell, whereby a pair of said connector head and said complementary connector head will be stably coupled; and a guide head cap having an inner thread and a rotary lock shell similar to said complementary connector bead so that said guide head cap can be coupled with either of said connector heads, a front end of said guide head cap being provided with a transverse through hole for passing a guide string; and an O-ring inserted between a structure selected from a pair of said connector head and said complementary connector head and a pair of said connector head and said guide head cap for providing a water-proof sealing effect;

wherein a guide string passes through said through hole of said guide end cap;

wherein said O-ring provides a water-proof seal when said structure selected from a pair of said connector head and said complementary connector head and a pair of said connector head and said guide head cap is placed in water; and wherein one end of said electric connector module can be connected with a cable of different specification equipped with said complementary connector head at a first end and an usual audio-video terminal at a second end thereof; and wherein said structure selected from a pair of said connector head and said complementary connector head and a pair of said connector head and said guide head cap is locked by an insertion means.

* * * * *